US005579738A

United States Patent [19]

Frischmuth et al.

[11] Patent Number: 5,579,738

[45] Date of Patent: Dec. 3, 1996

[54] RETURNLESS FUEL SYSTEM

[75] Inventors: Florian Frischmuth, Dearborn; Michael J. Cullen, Northville, both of Mich.

[73] Assignee: Ford Motor Company, Dearborn, Mich.

[21] Appl. No.: 617,721

[22] Filed: Apr. 1, 1996

[51] Int. Cl.[6] ..... F02M 37/04

[52] U.S. Cl. ..... 123/497

[58] Field of Search ..... 123/456, 458, 123/459, 495, 497, 514

[56] References Cited

U.S. PATENT DOCUMENTS

| | | | |
|---|---|---|---|
| 4,920,942 | 5/1990 | Fujimori et al. | 123/497 |
| 5,133,323 | 7/1992 | Treusch | 123/494 |
| 5,237,975 | 8/1993 | Betki et al. | 123/497 |
| 5,313,924 | 5/1994 | Regueiro | 123/456 |
| 5,355,859 | 10/1994 | Weber | 123/497 |
| 5,361,742 | 11/1994 | Briggs et al. | 123/497 |
| 5,379,741 | 1/1995 | Matysiewicz et al. | 123/497 |
| 5,398,655 | 3/1995 | Tuckey | 123/497 |
| 5,406,922 | 4/1995 | Tuckey | 123/497 |
| 5,411,002 | 5/1995 | Smitley | 123/497 |
| 5,448,977 | 9/1995 | Smith et al. | 123/478 |
| 5,542,395 | 8/1996 | Tuckey et al. | 123/497 |

*Primary Examiner*—Thomas N. Moulis
*Attorney, Agent, or Firm*—Allan J. Lippa

[57] ABSTRACT

A fuel delivery system is disclosed in which fuel pressure at a fuel rail is controlled by controlling electrical power applied to an electric fuel pump. The fuel pressure is controlled to maintain the minimum value required to meet two constraints. The first constraint is the quantity of desired fuel to be delivered by the injectors at wide-open throttle as a function of engine speed. The second constraint is to provide enough pressure to meet fuel requirements as the available fuel injector on-time decreases with increasing engine speed.

11 Claims, 2 Drawing Sheets

RETURNLESS FUEL SYSTEM

BACKGROUND OF THE INVENTION

The field of the invention relates to control of fuel delivery to an internal combustion engine via a returnless fuel system.

Conventional fuel systems deliver fuel to a fuel rail having fuel injectors connected thereto via an electric pump. Fuel pressure is maintained at the fuel rail by a pressure relief valve and return line back to the fuel tank.

Returnless fuel systems are also known in which the pressure relief valve and return fuel line are eliminated. Pressure at the fuel rail is maintained at a desired level by varying the voltage supplied to the fuel pump. Either the voltage amplitude is changed or a constant voltage amplitude is used and electrical power varied by pulse width modulating the voltage signal. An example of such system is shown in U.S. Pat. No. 5,355,859 in which fuel pressure is regulated as a function of engine load.

The inventors have recognized numerous problems with the above approaches. For example, more fuel pressure is applied than is needed over many engine operating conditions. Accordingly, electrical power is wasted resulting in a loss of fuel economy.

SUMMARY OF THE INVENTION

An object of the invention herein is to minimize fuel pressure at the fuel rail subject to the constraints of: providing sufficient fuel at wide-open throttle; and providing sufficient fuel at higher engine speeds when available fuel injector on-time is reduced.

The above object is achieved, and problems of prior approaches overcome, by providing both a system and a method for controlling fuel pressure delivered to at least one fuel injector of an internal combustion engine. The fuel pressure is controlled by controlling electrical power supplied to an electric fuel pump. In one particular aspect of the invention, the method comprises the steps of: determining a first quantity of desired fuel to be delivered by the injectors at wide open throttle as a function of engine speed, the first quantity of desired fuel comprising a first constraint; providing an available time duration of actuating of the injectors as a function of engine speed, the available time duration comprising a second constraint; generating a desired fuel pressure which is a minimum fuel pressure required to meet both the first and the second constraints; and applying electrical power to the fuel pump to maintain the desired fuel pressure.

An advantage of the above aspect of the invention is that fuel pressure is minimized while satisfying the constraints of: providing sufficient fuel at wide-open throttle; and providing sufficient fuel as available fuel injector on-time is reduced at higher engine speeds. Stated another way, fuel pressure and the resulting waste of electrical power are avoided by the above aspect of the invention. Another advantage is that lean excursions in the engine air/fuel ratio are avoided during heavy acceleration commonly referred to as tip-ins.

BRIEF DESCRIPTION OF THE DRAWINGS

The above object and advantages of the claimed invention will become more clearly apparent from the following detailed description of an example of operation described with reference to the drawings wherein:

DESCRIPTION OF AN EXAMPLE OF OPERATION

Figure 1:
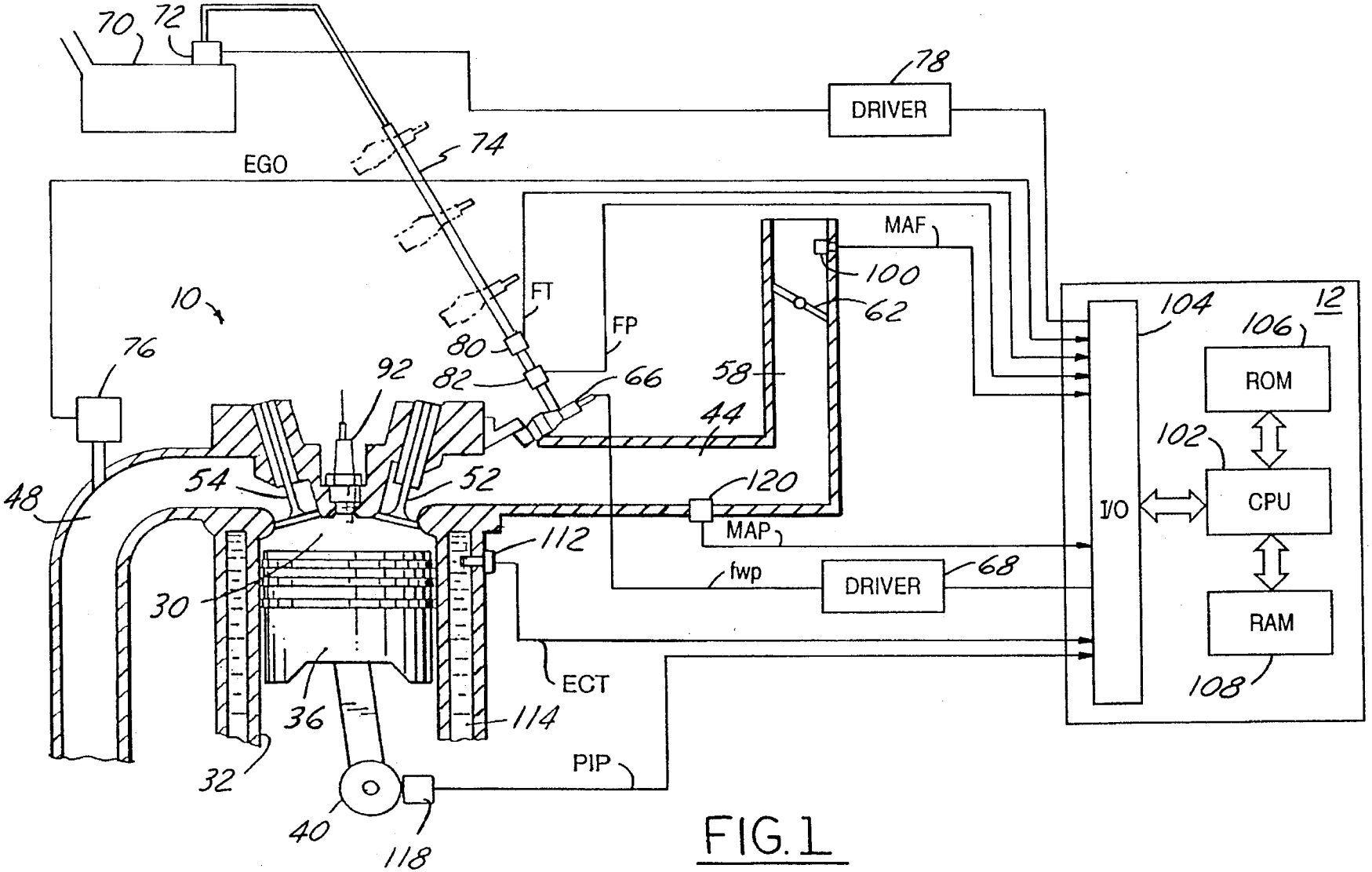
FIG. 1 is a block diagram of an embodiment in which the invention is used to advantage.

Internal combustion engine 10 comprising a plurality of cylinders, one cylinder of which is shown in FIG. 1, is controlled by electronic engine controller 12. Engine 10 includes combustion chamber 30 and cylinder walls 32. Piston 36 is positioned within cylinder walls 32 with conventional piston rings and it is connected to crankshaft 40. Combustion chamber 30 is shown communicating with intake manifold 44 and exhaust manifold 48 via respective intake valve 52 and exhaust valve 54. Intake manifold 44 is shown communicating with throttle body 58 via throttle plate 62. Intake manifold 44 is also shown having fuel injector 66 coupled thereto for delivering liquid fuel in proportion to the pulse width of signal fpw received from controller 12 via conventional electronic driver 68.

Fuel is delivered to fuel injector 66 by a conventional returnless fuel system including fuel tank 70, electric fuel pump 72, and fuel rail 74. Electric fuel pump 72 pumps fuel at a pressure directly related to the voltage applied to fuel pump 72 from controller 12 via conventional driver 78. In other applications, fuel pump 72 provides fuel at a pressure directly related to the pulse width and frequency of a modulation signal provided from controller 12 via driver 78. In this particular example, a separate fuel injector (not shown) for each engine cylinder is coupled to fuel rail 74. Also shown coupled to fuel rail 74 are fuel temperature sensor 80, providing fuel temperature signal FT, and fuel pressure sensor 82, providing fuel pressure signal FP.

Exhaust gas oxygen sensor 76 is shown coupled to exhaust manifold 48 for providing, in this particular example, signal EGO to controller 12 which converts it into two-state signal EGOS. A high voltage state of signal EGOS indicates exhaust gases are rich of a desired air/fuel ratio and a low voltage state of signal EGOS indicates exhaust gases are lean of the desired air/fuel ratio. Typically, the desired air/fuel ratio is selected at stoichiometry.

Controller 12 is shown in FIG. 1 as a conventional microcomputer including: microprocessor unit 102, input/output ports 104, an electronic storage medium for storing executable programs and calibration values shown as read only memory chip 106 in this particular example, random access memory 108, and a conventional data bus. Controller 12 is shown receiving various signals from sensors coupled to engine 10, in additional to those signals previously discussed, including: measurement of inducted mass air flow (MAF) from mass air flow sensor 100 which is coupled to throttle body 58; engine temperature (ET) from temperature sensor 112 which in this particular example is shown coupled to cooling jacket 114 and in other 5 applications may be coupled directly to the engine head; a profile ignition pickup signal (PIP) from Hall effect sensor 118 coupled to crankshaft 40; and intake manifold absolute pressure MAP from sensor 120 coupled to intake manifold 44.

Figure 2:
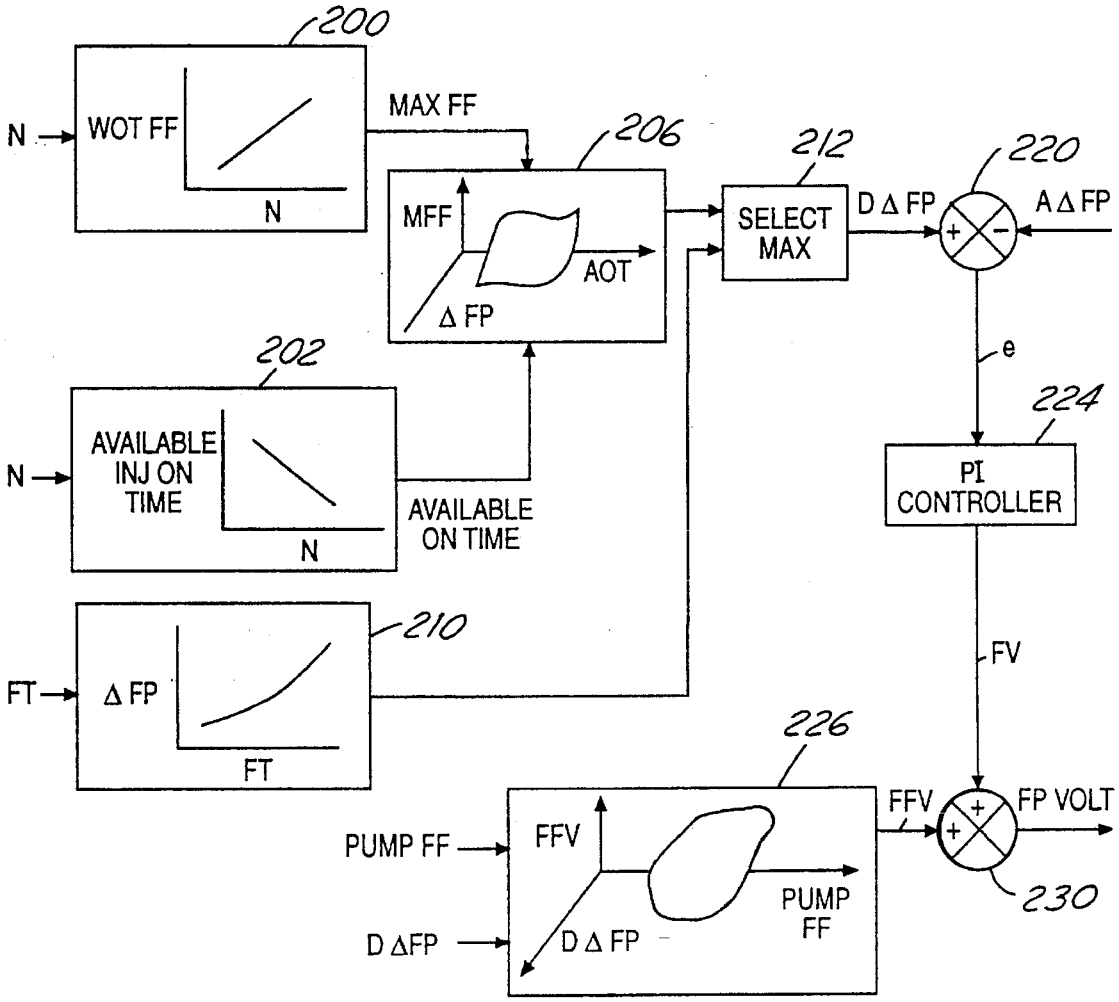
FIG. 2 represents a flowchart describing various operations performed by a portion of the embodiment shown in FIG. 1.

Various operations performed by controller 12 to maintain the delta fuel pressure between fuel rail 74 and intake manifold 44 at a minimum value while achieving three control constraints is now described with particular reference to the flowchart shown in FIG. 2. One controller restraint is described with reference to block 200 wherein maximum fuel flow signal MAXFF is that fuel flow required at wide open throttle (WOTFF) for a particular engine speed N. In this particular example, maximum fuel flow signal MAXFF is generated for an air/fuel ratio rich of stoichiometry. The maximum fuel flow required by engine 10 under the most extreme operating conditions is therefore provided.

Another constraint on minimum delta fuel pressure at fuel rail 74 is provided by the available "on-time" of fuel injector 66. As indicated in step 202, the available injector on-time is inversely related to engine speed N. Because fuel injector 66 must be on for a greater time duration at lower fuel pressures to deliver the same amount of fuel as when operating under higher fuel pressures, the available on-time for injector 66 becomes a limit on how low delta fuel pressure at fuel rail 74 may fall.

Block 206 indicates that a minimum desired delta fuel pressure (ΔFP) is obtained by a look-up table with inputs comprising the previously described constraints of available on-time (AOT) and maximum fuel flow (MFF). This minimum desired fuel pressure ΔFP, however, is not permitted to fall below that pressure which may cause vaporization of the fuel (210, 212). More specifically, block 210 provides that pressure (ΔFP) for a given fuel temperature (FT) which may cause fuel vaporization. Block 212 then selects the greater of the fuel pressure which may cause vaporization from block 210 or the minimum fuel pressure from block 206. The output of block 212 is shown as desired delta fuel pressure DΔFP.

Desired delta fuel pressure DΔFP is then compared to actual delta fuel pressure signal AΔFP in comparator 220 to generate error signal "e". Actual delta fuel pressure AΔFP is generated in one example of operation by subtracting signal MAP from signal FP. In another example, manifold pressure is inferred in a conventional manner from engine speed N and signal MAF. And the inferred manifold pressure signal is subtracted from signal FP to generate signal AΔFP. Conventional proportional plus integral controller (PID) 224 then generates feedback variable FV from error signal "e" in a conventional manner.

Feedback variable FV is added to open loop or feed forward voltage signal FFV from block 226 to generate fuel pump voltage FPVOLT in summer 230. In this particular example, feed forward voltage FFV is generated in block 226 as a function of desired delta fuel pressure DΔFP and fluid flow through pump 72 (PUMPFF). When added with feedback variable FV, the resulting voltage (FPVOLT) applied to pump 72 will drive error signal "e" towards zero for maintaining minimum desired delta pressure DΔFP subject to the above described constraints.

Figure 3:
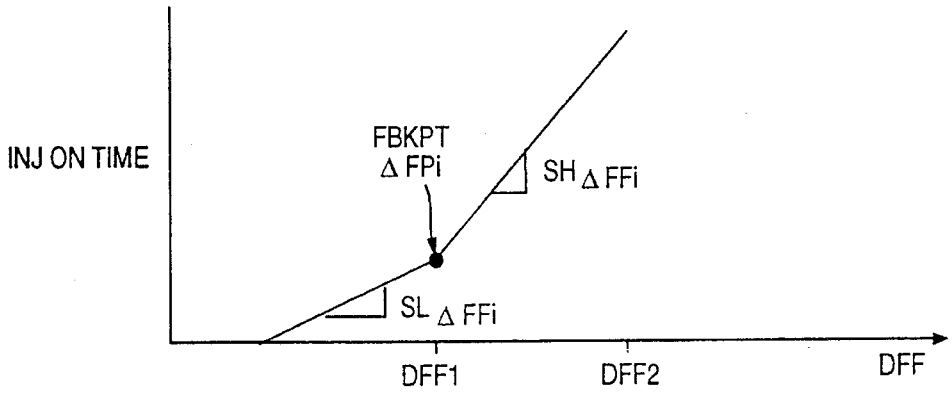
FIG. 3 is a graphical representation of various operations performed by a portion of the embodiment shown in FIG. 1.

The process for generating signal fpw, the pulse width of which activates fuel injector 66 to deliver the desired fuel flow (DFF) at desired fuel pressure DΔFP, is now described with particular reference to FIG. 3.

Desired fuel flow DFF, to be supplied by fuel injector 66 for combustion chamber 30, is given by the following equation:

$$DFF = F/Ad \cdot CYL\ AIR\ CHG/LAM$$

Where:

DFF is the desired fuel mass flow;

F/Ad is the desired fuel/air ratio which is stoichiometry under steady-state conditions;

CYL AIR CHG is the inducted air charge per cylinder which, in this particular example, is signal MAF divided by the number of cylinders; and LAM is the air/fuel feedback variable provided from the output of a proportional plus integral (PI) controller responsive to exhaust gas oxygen sensor 76.

The on-time of fuel injector 66 is provided from desired fuel flow DFF by the graph shown in FIG. 3. When desired fuel flow DFF is between DFF1 and DFF2, injector on-time is provided by multiplying slope $SH_{\Delta FPi}$ by desired fuel flow DFF. When desired fuel flow DFF is less than DFF1, which corresponds to the "break point" (FBKPT) between the two slopes shown in FIG. 3, injector on-time is generated by multiplying slope $SL_{\Delta FPi}$ times the desired fuel flow (DFF). As shown in FIG. 3, each slope ($SH_{66\ FPi}$ and $SL_{66\ Fpi}$), and the break point between the two slopes ($FBKPT_{\Delta FFi}$) are functions of fuel pressure at fuel rail 74 (AΔFP). And desired fuel pressure DΔFP is selected so that desired fuel flow DFF occurs between DFF1 and DFF2 for more accurate fuel control.

This concludes the description of an example of operation which uses the claimed invention to advantage. Those skilled in the art will be aware of numerous other examples which practice the claimed invention. Accordingly, it is intended that the invention be limited only by the following claims:

What is claimed:

1. A method for controlling fuel pressure delivered to at least one fuel injector of an internal combustion engine by controlling electrical power supplied to an electric fuel pump coupled to the fuel injectors, the method comprising the steps of:

determining a first quantity of desired fuel to be delivered by the injectors at wide open throttle as a function of engine speed, said first quantity of desired fuel comprising a first constraint;

providing an available time duration for actuating of the injectors as a function of engine speed, said available time duration comprising a second constraint;

generating a desired fuel pressure which is a minimum fuel pressure required to meet both said first and said second constraints; and applying electrical power to the fuel pump to maintain the desired fuel pressure.

2. The method recited in claim 1 further comprising the steps of:

generating a desired fuel quantity to be delivered by the injectors as a function of engine operating parameters including quantity of air inducted into the engine and desired engine air/fuel ratio; and generating an actuating signal with a pulse width which when applied to the injectors will provide said desired fuel quantity at said desired fuel pressure.

3. The method recited in claim 1 wherein said step of generating said desired fuel pressure further comprises a step of preventing said desired fuel pressure from falling below a fuel pressure at which the fuel would vaporize.

4. The method recited in claim 1 wherein said step of applying electrical power to maintain said desired fuel pressure is responsive to a feedback variable derived from a difference between said desired fuel pressure and an indication of actual fuel pressure.

5. The method recited in claim 1 wherein said step of applying electrical power to maintain the desired fuel pressure is responsive to a feed forward variable derived from said desired fuel pressure and from fuel flow through the fuel pump.

6. A method for controlling fuel pressure delivered to at least one fuel injector coupled to an intake manifold of an internal combustion engine by controlling electrical power supplied to an electric fuel pump coupled to the fuel injectors, the method comprising the steps of:

determining an actual delta fuel pressure between the injector and the intake manifold;

determining a first quantity of desired fuel to be delivered by the injectors at wide open throttle as a function of engine speed, said first quantify of desired fuel comprising a first constraint;

providing an available time duration for actuating of the injectors as a function of engine speed, said available time duration comprising a second constraint;

generating a desired delta fuel pressure between the injectors and intake manifold which is a minimum fuel pressure required to meet both said first and said second constraints; and applying electrical power to the fuel pump to drive a difference between said actual delta fuel pressure and said desired delta fuel pressure towards zero.

7. The method recited in claim 6 wherein said step of generating said desired delta fuel pressure further comprises a step of preventing said desired delta fuel pressure from falling below a fuel pressure of which the fuel may vaporize.

8. The method recited in claim 6 wherein said step of applying electrical power to maintain said desired delta fuel pressure is responsive to a feedback variable derived from a difference between said desired delta fuel pressure and said actual delta fuel pressure.

9. A fuel delivery system for an internal combustion engine having an intake manifold, comprising:

at least one fuel injector coupled to the intake manifold;

an electric fuel pump coupled between the fuel injectors and a source of fuel;

a pressure sensor coupled to the fuel injectors;

a controller providing a first constraint by determining a first quantity of desired fuel to be delivered by the injectors at wide open throttle as a function of engine speed, said controller also providing a second constraint by determining an available time duration for actuating of the injectors as a function of engine speed, said controller also determining a desired fuel pressure to meet both said first and said second constraints; and means responsive to said pressure sensor for applying electrical power to the fuel pump to maintain the desired fuel pressure.

10. The system recited in claim 9 wherein said controller generates a desired fuel quantity to be delivered by the injectors as a function of engine operating parameters including quantity of air inducted into the engine and desired engine air/fuel ratio; and generates an actuating signal with a pulse width which when applied to the injectors will provide said desired fuel quantity at said desired fuel pressure.

11. The method recited in claim 10 wherein said controller prevents said desired fuel pressure from falling below a fuel pressure at which the fuel would vaporize.

* * * * *